US006182598B1

(12) United States Patent
Bozzo

(10) Patent No.: US 6,182,598 B1
(45) Date of Patent: Feb. 6, 2001

(54) STAIR ASSEMBLY FOR MARINE CRAFT

(76) Inventor: Horacio E. Bozzo, 1000 Parkview Dr. #117, Hallandale, FL (US) 33009

( * ) Notice: Under 35 U.S.C. 154(b), the term of this patent shall be extended for 0 days.

(21) Appl. No.: 09/264,929

(22) Filed: Mar. 9, 1999

(51) Int. Cl.[7] ..... B63B 17/00
(52) U.S. Cl. ..... 114/362
(58) Field of Search ..... 114/362; 182/82, 182/88, 90, 91, 95, 96, 97, 127; 244/129.6

(56) References Cited

U.S. PATENT DOCUMENTS

| | | | | |
|---|---|---|---|---|
| 2,097,991 | * | 11/1937 | Sikorsky | 244/129.6 |
| 2,493,639 | * | 1/1950 | Pellegrini | 182/95 |
| 2,641,785 | * | 6/1953 | Pitts et al. | 14/71.1 |
| 3,528,574 | * | 9/1970 | Denner et al. | 414/558 |
| 3,847,246 | * | 11/1974 | Banner | 182/78 |
| 3,892,290 | * | 7/1975 | Lang | 182/22 |
| 4,068,770 | * | 1/1978 | Boehringer | 214/85 |
| 4,453,684 | * | 6/1984 | Hanks | 244/129.5 |
| 4,989,691 | * | 2/1991 | Wilkerson et al. | 182/70 |
| 5,224,437 | * | 7/1993 | Stanescu | 114/362 |
| 5,335,880 | * | 8/1994 | Klug | 24/118.3 |
| 5,537,949 | * | 7/1996 | Blevins et al. | 114/362 |
| 5,832,864 | * | 11/1998 | Hemphill | 114/335 |
| 5,887,540 | * | 3/1999 | Krish, Jr. | 114/362 |
| 5,915,328 | * | 6/1999 | Rowan | 114/362 |

FOREIGN PATENT DOCUMENTS

| | | | | |
|---|---|---|---|---|
| 1077096 | * | 3/1960 | (DE) | 114/362 |
| 140287 | * | 8/1982 | (JP) | 114/362 |
| 404100793 | * | 4/1992 | (JP) | 114/362 |

* cited by examiner

*Primary Examiner*—S. Joseph Morano
*Assistant Examiner*—Ajay Vasudeva
(74) *Attorney, Agent, or Firm*—Robert M. Downey, P.A.

(57) ABSTRACT

A stair assembly to enable easy boarding and deboarding of a watercraft includes one or more step members hingedly fixed within a cavity formed with the bow, side walls or transom of the watercraft to permit the step members to swing, in a rolling movement, from a compact stowed position to an extended, deployed position wherein the stair assembly extends outboard of the watercraft. The step members are specifically shaped and configured to conform with the bow, side walls and/or transom when in the stowed position to thereby fill the cavity and provide an integral, seaworthy structure.

8 Claims, 7 Drawing Sheets

STAIR ASSEMBLY FOR MARINE CRAFT

BACKGROUND OF THE INVENTION

1. Field of the Invention

The present invention relates to a stair assembly for a watercraft and, more specifically, to a stairway having hinged step members fitted within a cavity formed in the bow, side walls or transom of a watercraft, wherein the stair assembly is movable between a compact, stowed position within the cavity and a deployed, outboard extending position to thereby permit boarding and deboarding of the watercraft.

2. Discussion of the Related Art

Various stairways and ladders are well known in the marine industry to permit passage between a watercraft and a dock, body of water, adjacent vessel and the like. For instance, there are numerous types of gangways which are normally used on larger vessels to permit boarding and deboarding when the vessel is tied up along side a pier or dock. Furthermore, swim ladders are extensively used on boats of all sizes to enable passengers to climb aboard the boat from within the water.

While the various stair and ladder structures known in the industry are generally suitable for their intended purpose, there still exists a need for a stair assembly which is structured to permit easy passage when boarding and deboarding a watercraft. More particularly, there exists a need for a stair assembly which accommodates people of all ages and sizes, permitting easy boarding and deboarding from the watercraft into the water, onto a beach or onto an adjacent structure such as a dock or another vessel.

SUMMARY OF THE INVENTION

The present invention is directed to a stair assembly for use on a watercraft to permit easy boarding and deboarding between the watercraft and a body of water, a beach, or a rigid structure such as a dock or adjacent vessel. The stair assembly includes one or more step members hingedly fixed to one another and to the watercraft. The step members are collapsible into a compact, stowed position so that the assembly fits within a cavity formed in the bow, side walls or transom of the watercraft. When in the stowed position, the stair assembly is integral with the surrounding bow, side wall, or transom structure. A joint between the stair assembly and hull structure is watertight, thereby providing a seaworthy structure which prevents water from entering the watercraft when travelling on the water.

The stair assembly swings open, in a rolling movement, from the stowed position to an extended, deployed position. In the deployed position, the stair assembly extends outboard of the watercraft to expose step surfaces which may be provided with a non-skid texture or paint. In the deployed position, the stair assembly can be extended into the water so that a distal free end of the stair assembly is positioned below the surface of the water. In this manner, a person swimming in the surrounding water can easily climb aboard the watercraft by walking up the stairway. Likewise, the stairway can be extended to an adjacent shoreline, a dock, or another vessel. To assist a person travelling the stair assembly, handrails may be fitted along the opposite sides, extending the length of the stair assembly.

In one preferred embodiment of the invention, the stair assembly is specifically structured and configured for installation on a rigid hull inflatable watercraft. In this particular embodiment, the under side of the step members are provided with a radius so that when the stair assembly is collapsed to the stowed position, the assembly assumes a cylindrical configuration which is congruent with the inflatable tube sections surrounding the watercraft. Thus, the diameter of the formed cylinder of the stair assembly is the same as the diameter of the inflatable tubes of the watercraft thereby providing an integral structure.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
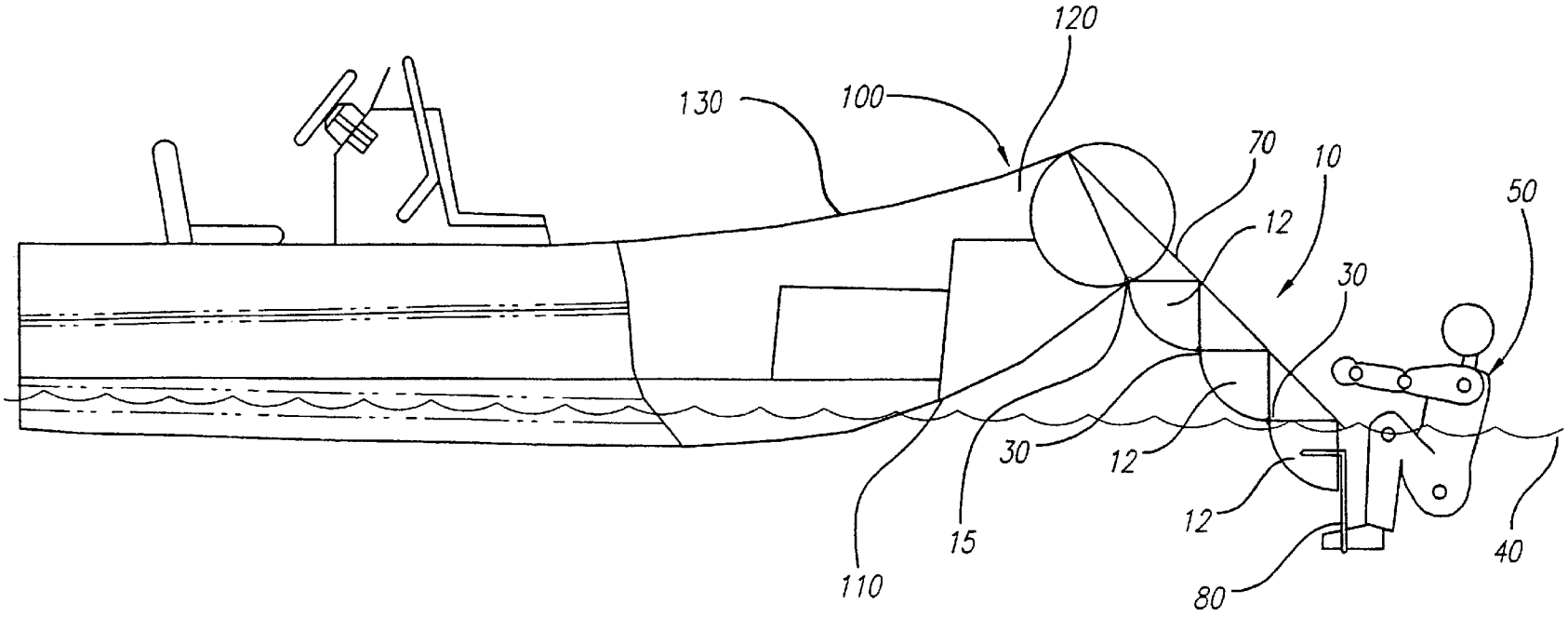
FIG. 1 is a side elevation, in partial cutaway, showing the stair assembly fitted to the bow of a rigid hull inflatable watercraft.
Figure 2:
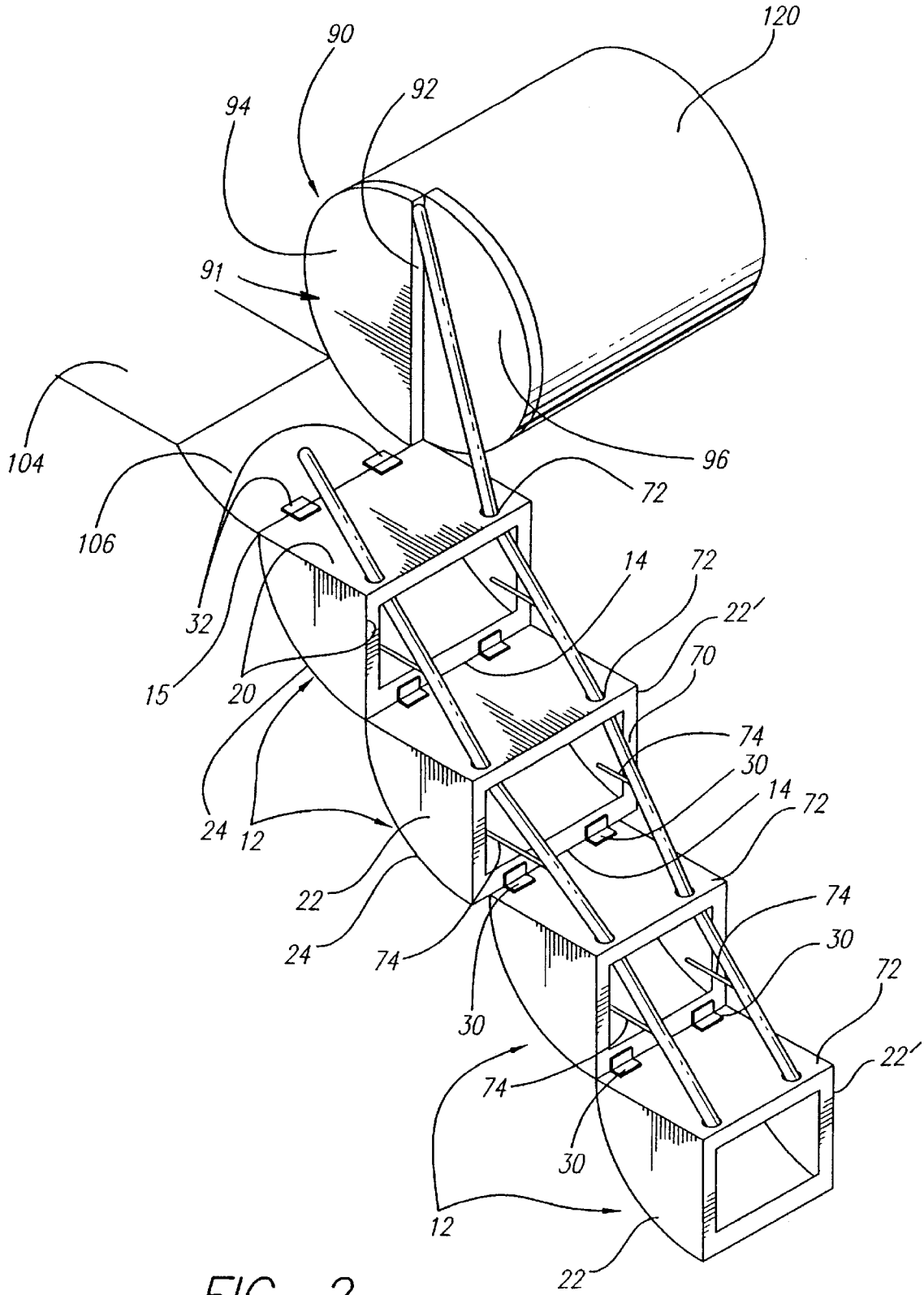
FIG. 2 is an isolated top perspective view of the stair assembly, shown in an extended position, and fitted to a rigid hull inflatable watercraft to be integral with the surrounding inflatable tube structure of the watercraft when the stair assembly is in a stowed position.

Referring to the several views of the drawings, and initially FIGS. 1 and 2, the stair assembly of the present invention is shown and generally indicated as 10. The stair assembly 10 includes one or more step members 12 that are hinged together. The uppermost step member 12 hinges to the hull structure 110 of a marine craft 100 along edge 15.

It is contemplated that the stair assembly 10 be mounted to the hull structure 110 of the marine craft 100 within a cavity or opening formed in the bow, side walls, or transom of the marine craft 100. In the instant embodiment, the stair assembly 10 is shown fitted to the bow of a rigid hull inflatable marine craft. In this particular embodiment, an opening is formed along a segment of the inflatable tubes 120 of the marine craft 100, providing a cavity to accommodate the stair assembly 10 when the stair assembly is in its compact, stowed position and permitting passage through the cavity to traverse the stair assembly 10 when the stair assembly is in its extended, deployed position.

Figures 4A, 4B, 4C, 4D:
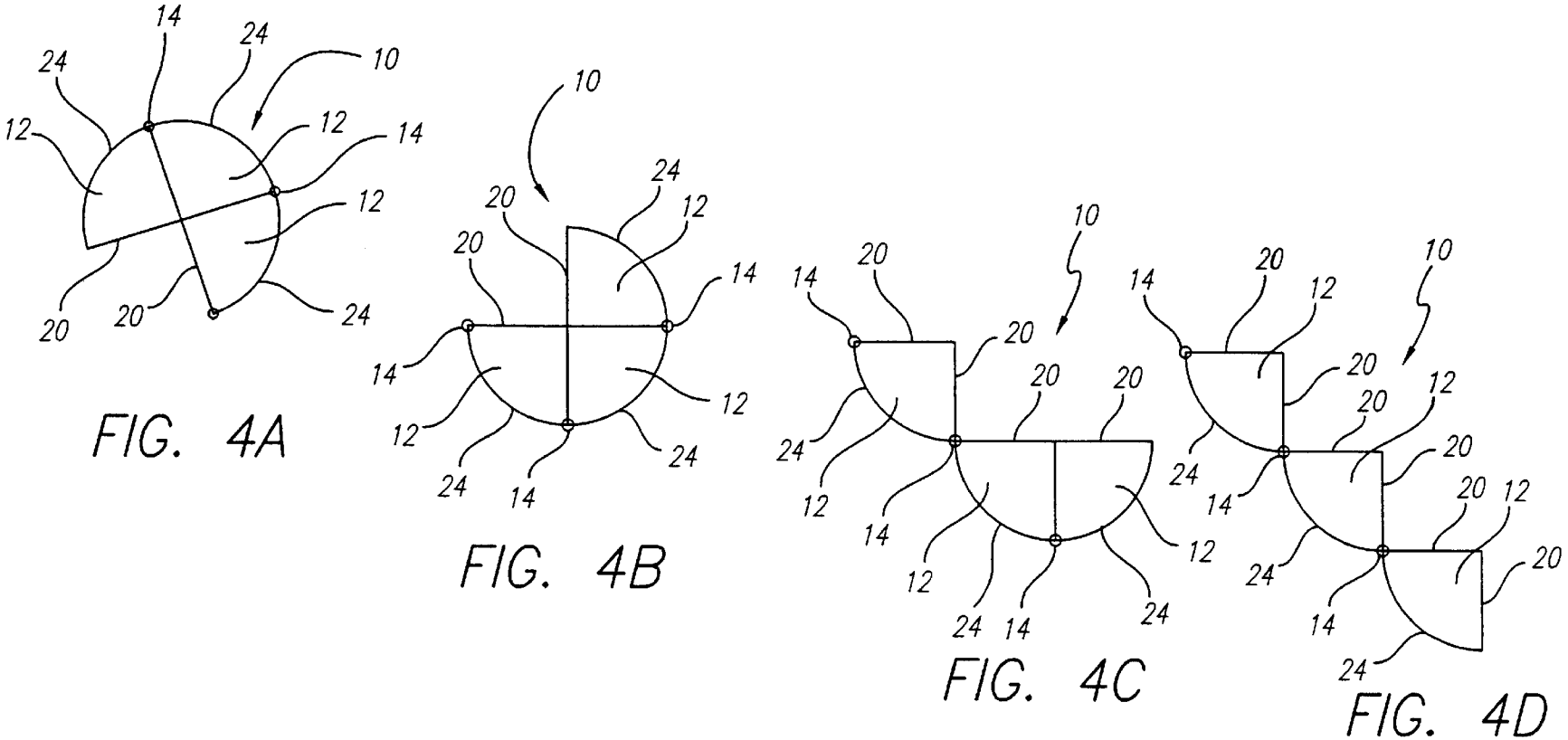
FIGS. 4A–4D illustrate a sequence of movement of the stair assembly from a compact, stowed position to a fully extended, deployed position.
Figure 5A:
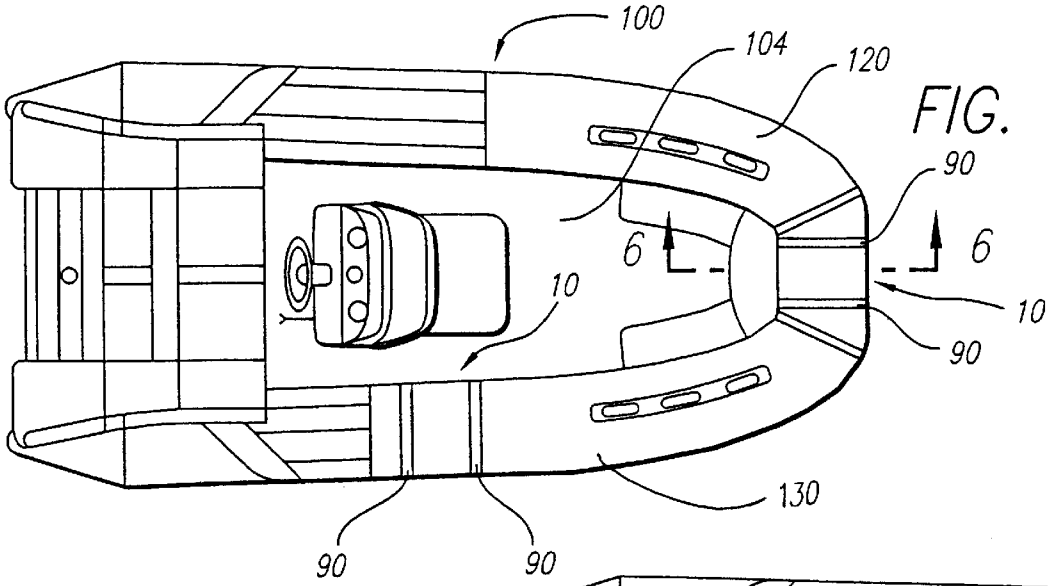
FIG. 5A is a top plan view of a watercraft showing the stair assembly fitted to a surrounding wall structure of the watercraft at both the bow and the starboard side, wherein the stair assembly is in a stowed position.
Figure 5B:
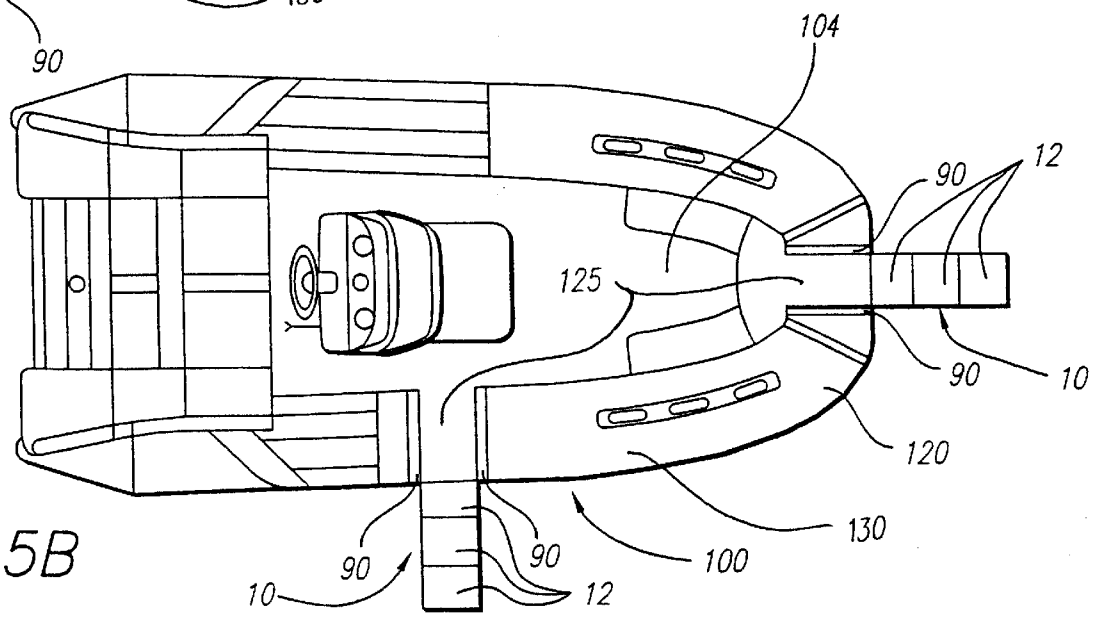
FIG. 5B is a top plan view of the watercraft of FIG. 5A showing the stair assemblies at the bow and starboard side in the extended, deployed position.
Figure 6:
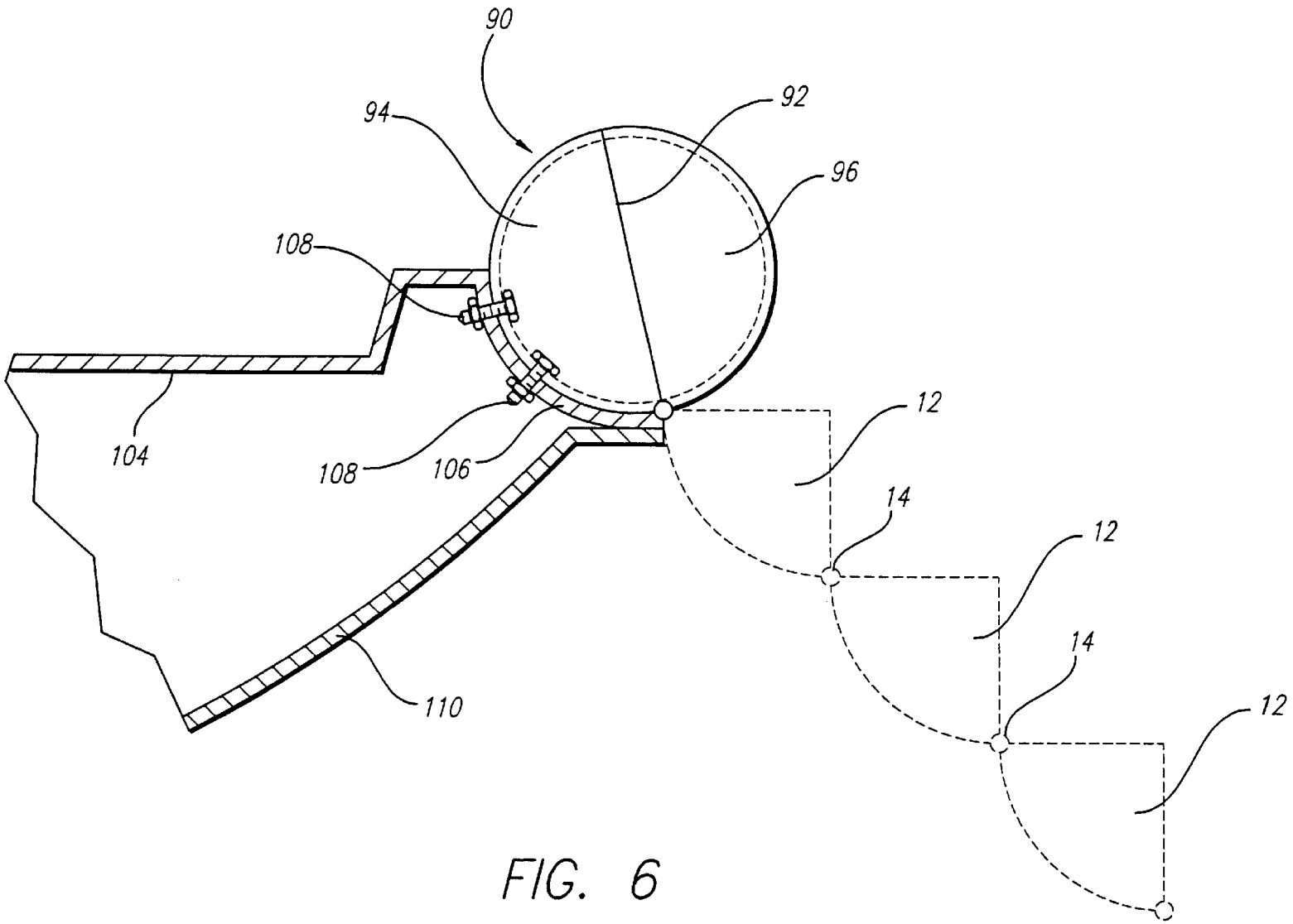
FIG. 6 is an isolated view, in cross section, taken along the plane of the line 6—6 of FIG. 5A.

Referring to FIG. 2, each of the step members 12 include an upper portion having at least one top step surface 20, opposite sides 22, 22', and a bottom side 24, and upper and lower transverse edges 14 between the top and bottom portions. The step surfaces 20 of each of the step members 12 may be provided with a non-skid texture and/or a non-skid paint or coating material. The bottom side 24 is specifically shaped and configured to conform with the structure of the bow, side walls, or transom of the marine craft 100, in accordance with the location of installation. In the particular embodiment shown, the bottom sides 24 of the step members 12 are provided with a rounded configuration, in accordance with a specific radius, so that when the stair assembly 10 is rolled up in a compact, stowed position, as seen in FIGS. 1, 4 and 6, the stair assembly 10 conforms generally with the configuration 106 of the hull structure 110, as well as the tubes 120 on opposite sides of the stowed stair assembly. More specifically, the configuration of the stowed stair assembly 10 is at least partially cylindrical to conform to the configuration of the cradle configuration 106 of the hull and cylindrical shape of the inflatable tube sections 120 on each side of the stair assembly 10. In one preferred embodiment, the stair assembly is mounted within cavity 125, between the inflatable tubes 120 of the marine craft with the use of a mounting assembly 90. The mounting assembly 90 includes cap means 91 mounted to an end of the tube 120, facing the cavity, and including a first portion 94 and a second portion 96. A shoulder 92 is formed between the first portion 94 and the second portion 96, defining an abutment shoulder which mates with the top step surface 20 of the first step member when the stair assembly is folded into the stowed position. More specifically, the first and second step members collapse to form a semi-cylindrical configuration adjacent the first portion 96 of the cap means 91 and disposed in abutting engagement with the shoulder 92. The third and fourth step members are narrower in width and collapse between the second portions 94 of the opposing cap means 91 facing inwardly towards the cavity. Thus, the abutment shoulder 92 serves to provide a water tight seal between the stair assembly and the cap means 91. To further provide a water tight seal, the abutment shoulder 92 may be provided with a rubber strip or another type of sealing membrane material. Each of the cap means 91 are mounted to the cradle portion 106 of the hull 110 with through bolts 108, as seen in FIG. 6. The outer configuration of the cap means 91 is specifically structured to be congruent with the configuration of the cradle portion 106, to provide mating, sealing engagement therewith. A silicone or other watertight sealing material should be placed between the mating surfaces of the cap means 91 and the cradle portion 106 to provide a watertight attachment thereto.

When the stair assembly 10 is opened to one of various deployed positions, as seen in FIGS. 1, 2, 3 and 5, the stair assembly 10 extends outboard of the marine craft 100. In FIG. 1, the stair assembly 10 is shown extending down below the surface 40 of the water, enabling a person 50 to walk up the stair assembly 10 and into the marine craft 100. When in the deployed position, the cavity 125 formed through the bow, side walls or transom of the marine craft 100 provides a walk-through passage. This enables persons traversing the stair assembly 10 to board and de-board the marine craft 100 without having to climb over the gunwale 130 of the marine craft 100. The lowermost step member may further be provided with a folding ladder 80 formed of aluminum, stainless steel, polyvinyl chloride, fiberglass, or other like corrosion resistant material. The folding ladder 80 is hingedly attached to the lowermost step member and is movable between a collapsed, stowed position against the bottom of the step member and an operable position (as shown in FIG. 1) extending beyond the lower transverse edge of the lowermost step member, and generally downward therefrom.

Referring to FIGS. 4A–4D, a sequence of movements of four step members 12 is shown, moving from the compact, stowed position to an extended, deployed position. As is seen in FIGS. 4A–4D, the movement of the step members 12 is in a generally rolling motion, wherein each of the step members 12 rotates through a predetermined arc (limited by rope 70, stop members 60, or articulated hinge 66, as described more fully hereinafter) about the respective hinge 30 connecting adjacent step members 12 until reaching the desired deployed position. Referring to FIGS. 4A–4D, a sequence of movements of three step members 12 is shown and being deployed from a compact, stowed position to an extended, deployed position in a generally rolling motion.

Figure 3:
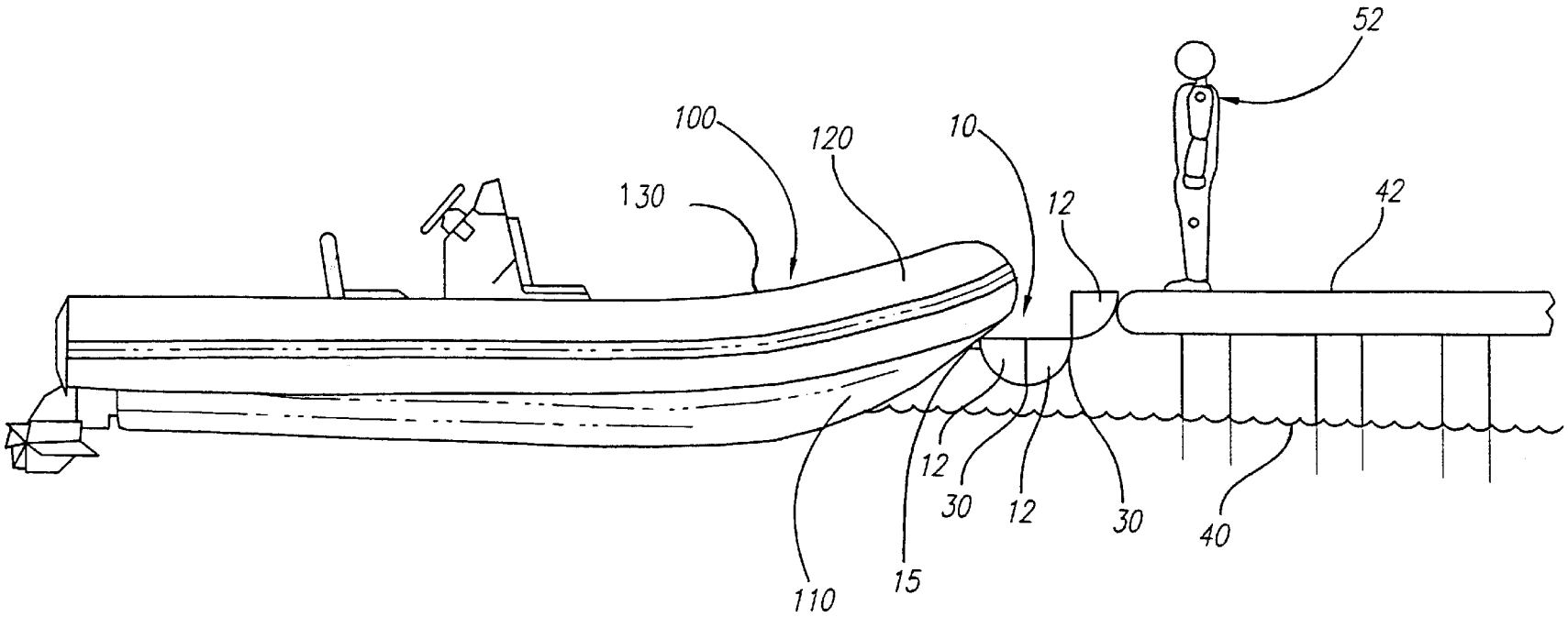
FIG. 3 is a side elevation showing the stair assembly extending to a dock structure to facilitate boarding and deboarding of the watercraft.

In FIG. 3, the stair assembly 10 is shown extending outward above the water 40 to a dock 42, thereby enabling persons to traverse the stair assembly 10 and board and de-board from the dock 42. Means are provided for releasably locking the step members 12 into folded or unfolded positions as required. In the present embodiment, the upper most and lower most step members 12 are locked in an unfolded, extended position and the middle step member 12 is locked in a folded position against the upper most step member 12, thereby creating a traversable bridge between the marine craft 100 and the dock 42.

It should be noted that the step members 12 may be manufactured of many suitable composites such as fiberglass reinforced plastic, kevlar, carbon, plastic, PVC, aluminum, steel, or rubber (similar to the inflatable tubes of the illustrated marine craft). Furthermore, the interior of the step members 12 may be hollow and may utilize grates over the step surfaces to support the weight of a person 50 while also permitting water to fill the interior of the step members so that they sink when deployed overboard in the extended, operable position.

Hinges 30 are used for attaching adjacently positioned step members to one another along the upper and lower transverse edges 14 for permitting hinged movement of the step members in a generally rolling motion between the compact, stowed position, and the extended, deployed position as shown in FIGS. 1, 4 and 6. Hinges 32 are utilized to attach the uppermost step member 12 along its upper transverse edge 14 to the deck 104 or the hull 110 of the marine craft 100. Means are also provided for releasably locking the step members 12 into the stowed, compact position.

Various means are available for stopping the hinged movement of the step members beyond the extended, deployed position. The fully extended position is reached when the attached step members form a stairway that extends away from the marine craft with the step surfaces positioned and maintained horizontal.

Figure 7C:
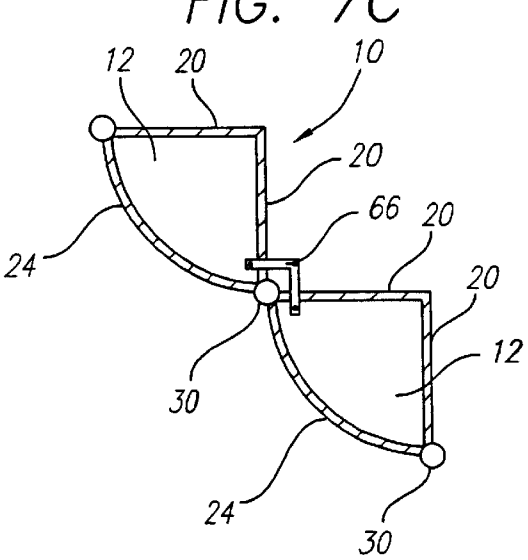
FIG. 7C is an isolated view, in partial section, illustrating yet another embodiment of the hinge and stop means.
Figure 7B:
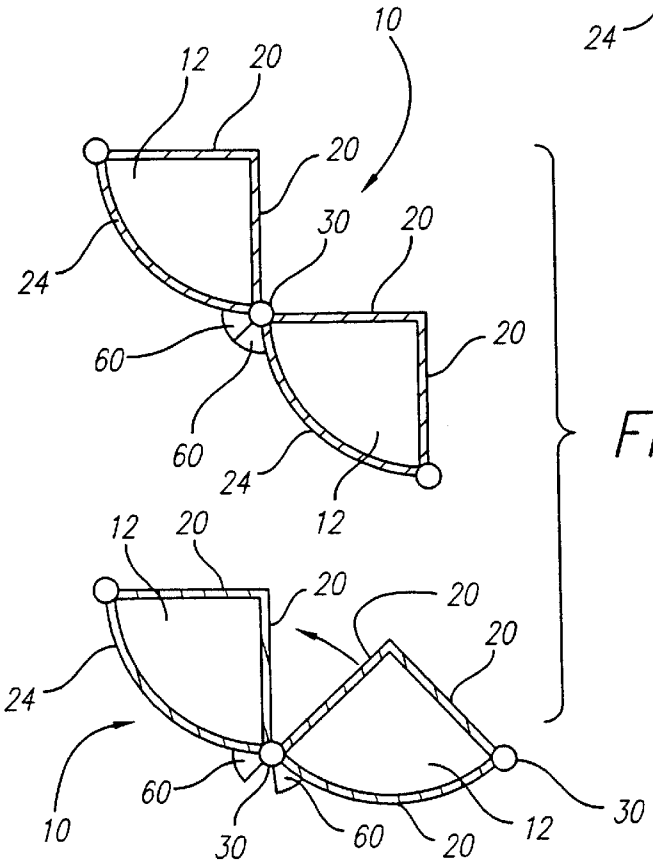
FIG. 7B is an isolated view, in partial section, showing another embodiment of the hinge and stop means.
Figure 7A:
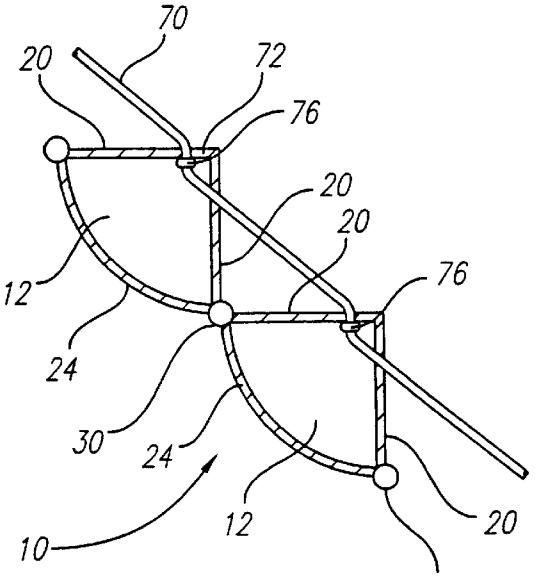
FIG. 7A is an isolated elevational view, in partial section, showing one preferred embodiment of a hinge and stop means for limiting hinged movement of the step members of the stair assembly.

One such means for stopping the hinged movement is shown in FIGS. 2 and 7A and uses ropes threaded through holes 72 in the step members 12 with knots 76 at fixed spaced intervals along the ropes 70. Each of the knots 76 are structured and disposed to engage an under side surface of the respective step members 12 upon the respective step member 12 reaching the extended, deployed position, and thereby preventing further, hinged, opening movement of the respective step member 12 beyond the extended, deployed position. In the preferred embodiment, as shown in FIG. 2, an elastic cord 74 is attached between each respective step member 12 and a location on the rope 70 midway between the knot 76 engaging the respective step member 12 and the knot 76 engaged to the next lower step member 12. The elastic cords 74 pull the rope 70 inside the step members 12 when the stair assembly 10 is retracted to a stowed position. The ropes 70 are further used as a means for lifting and retracting the step members 12 from the extended, deployed position to stowed position.

An alternate embodiment for stopping hinged movement of the step members is shown in FIG. 7B wherein opposing stop members 60 are positioned on the bottom 24 of the step members 12. The stop members 60 are positioned and disposed to mate in abutting engagement upon adjacently positioned step members 12 reaching the extended, deployed position, thereby preventing further hinged, opening movement of the adjacently positioned step members 12 beyond the extended, deployed position.

While the instant invention has been shown and described in connection with a preferred and practical embodiment thereof, it is recognized that departures may be made from the instant disclosure which, therefore, should not be limited except as defined in the following claims as interpreted under the doctrine of equivalents.

Now that the invention has been described,

What is claimed is:

1. A stowable stair assembly in combination with a marine craft having an outer side wall structure with a cavity formed therein, said stair assembly comprising:

a plurality of step members each including a top portion, a bottom portion, opposite sides and upper and lower transverse edges between said top and bottom portions, and said top portion including at least one step surface;

hinge means for attaching adjacently positioned step members to one another and for permitting hinged movement of said step members in a generally rolling motion between a compact, stowed position and an extended, deployed position;

means for stopping hinged movement of said step members beyond said extended, deployed position;

means for mounting said stair assembly to said marine craft and including cap means on opposite sides of the cavity for receiving said plurality of step members in said compact, stowed position, said cap means including an abutment shoulder structured and disposed for mating engagement with at least one of said plurality of step members when in said compact, stowed position, means on said abutment shoulder for providing a water tight seal between said plurality of step members and said cap means, and said plurality of step members being structured and disposed to fill the cavity and conform with the configuration of the outer side wall structure of the marine craft when in said compact, stowed position.

2. A stair assembly as recited in claim 1 wherein said means for stopping hinged movement of said step members comprises:

a rope threaded through said step members and including a plurality of stop members at fixed spaced intervals along at least a portion of a length of said rope, each of said stop members being structured and disposed to engage a respective one of said step members upon said respective step member reaching said extended, deployed position, and thereby preventing further hinged, opening movement of said respective step member beyond said extended, deployed position.

3. A stair assembly as recited in claim 1 wherein said means for stopping hinged movement of said step members comprises a pair of opposing stop members, each one of said opposing stop members being positioned on said bottom portion of a corresponding one of said adjacently positioned step members and said opposing stop members being structured and disposed to mate in abutting engagement upon said adjacently positioned step members reaching said extended, deployed position, thereby preventing further hinged, opening movement of said adjacently positioned step members beyond said extended, deployed position.

4. A stair assembly as recited in claim 1 further comprising a folding ladder hingedly attached to a lowermost one of said plurality of step members and being moveable between a collapsed, stowed position against said lowermost step member, to an operable position extending beyond said lowermost step member.

5. A stair assembly in combination with a marine craft having an outer side wall structure with a cavity formed therein, said stair assembly comprising:

a plurality of step members each including a top portion, a bottom portion, opposite sides, and upper and lower transverse edges between said top and bottom portion, and said top portion including at least one step surface;

hinge means for attaching adjacently positioned step members to one another and for permitting hinged movement of said step members in a generally rolling motion between a compact, stowed position to fill said cavity and an extended, deployed position extending outboard of the marine craft and thereby permitting passage through said cavity to traverse said stair assembly;

means for stopping hinged movement of said step members beyond said extended, deployed position;

means for mounting said stair assembly to said marine craft;

means for providing a water tight seal between said stair assembly and said surrounding wall structure of the marine craft when said plurality of step members are in said compact, stowed position; and said plurality of step members being structured and disposed to fill the cavity and conform with the configuration of the outer side wall structure of the marine craft when in said compact, stowed position.

6. A stair assembly as recited in claim 5 wherein said means for stopping hinged movement of said step members comprises:

a rope threaded through said step members and including a plurality of stop members at fixed spaced intervals along at least a portion of a length of said rope, each of said stop members being structured and disposed to engage a respective one of said step members upon said respective step member reaching said extended, deployed position, and thereby preventing further hinged, opening movement of said respective step member beyond said extended, deployed position.

7. A stair assembly as recited in claim 5 wherein means for stopping hinged movement of said step members comprises a pair of opposing stop members, each one of said opposing stop members being positioned on said bottom portion of a corresponding one of said adjacently positioned step members and said opposing stop members being structured and disposed to mate in abutting engagement upon said adjacently positioned step members reaching said extended, deployed position, thereby preventing further hinged, opening movement of said adjacently positioned step members beyond said extended, deployed position.

8. A stair assembly as recited in claim 5 further comprising a folding ladder hingedly attached to a lowermost one of said plurality of step members and being moveable between a collapsed, stowed position against said lowermost step member, to an operable position extending beyond said lowermost step member.

* * * * *